United States Patent [19]

Gulick

[11] Patent Number: 5,007,647

[45] Date of Patent: Apr. 16, 1991

[54] GOLF BALL AND METHOD OF MAKING SAME

[75] Inventor: James D. Gulick, Peoria, Ariz.

[73] Assignee: Sports Glow, Inc., Scottsdale, Ariz.

[21] Appl. No.: 452,259

[22] Filed: Dec. 15, 1989

[51] Int. Cl.[5] ..... A63B 43/06; A63B 37/12

[52] U.S. Cl. ..... 273/213; 273/DIG. 24; 273/DIG. 22; 264/132

[58] Field of Search ..... 273/213, 235 A, 235 B, 273/DIG. 24, 220, DIG. 22; 156/146; 40/327; 29/400.1; 264/132

[56] References Cited

U.S. PATENT DOCUMENTS

| | | | |
|---|---|---|---|
| 716,645 | 12/1902 | Ransom | 273/DIG. 24 |
| 1,622,421 | 3/1927 | Coffield | 273/213 |
| 2,050,402 | 8/1936 | Walsh | 273/DIG. 24 |
| 4,798,386 | 1/1989 | Berard | 273/DIG. 24 |
| 4,802,674 | 2/1989 | Kitaoh | 273/235 A |
| 4,865,326 | 9/1989 | Isaac et al. | 273/235 A |

*Primary Examiner*—George J. Marlo
*Attorney, Agent, or Firm*—Harry M. Weiss

[57] ABSTRACT

A luminescent or phosphorescent golf ball, which emits a luminescent glow, is provided, for ease of finding the ball in the dark. A method of manufacture is also provided. Three embodiments are disclosed. In one embodiment, the golf ball includes a flexible core which has a primer coat disposed over the core outer surface and, a luminescent or phosphorescent coating is applied thereto followed by encapsulating the flexible core with its luminescent outer coating with a transparent, hard plastic cover. A second embodiment uses any conventional golf ball and applies the primer coat and luminescent coat thereto. The third embodiment provides a luminescent outer plastic cover that encapsulates a flexible core.

9 Claims, 1 Drawing Sheet

GOLF BALL AND METHOD OF MAKING SAME

FIELD OF THE INVENTION

This invention generally relates to golf balls and methods of manufacture thereof, and in particular this invention relates to glow-in-the-the dark golf balls and fabrication methods therefor.

BACKGROUND OF THE INVENTION

The conventional prior art golf ball usually includes a flexible (usually rubber) core member and a relatively hard (usually plastic) cover portion disposed over the flexible core member.

One problem with the conventional prior art golf ball is that it cannot be readily seen in the dark. Often, golfers seeking to finish a round of golf before darkness will try to rush through the last few holes in order to complete the round. In doing this, golfers will usually become frustrated because their rushed shots are generally not as good as their carefully stroked and planned shots. Also, golf balls are often lost because of darkness during attempts by golfers to finish their rounds.

One attempt to deal with this problem of playing golf at dark has been the development of a golf ball which had a hole drilled through the ball for the insertion therein of glow type material which made the golf ball easier to see at dusk or even during darkness. U.S. Pat. No. 4,695,055 discloses this prior golf ball with a hole therethrough.

Various problems are associated with this type of a golf ball. First of all, a golfer usually has to use more than one of these glow type material inserts for this type of golf ball to fully complete 18 holes of golf. Furthermore, this type of golf ball is structurally changed thereby eliminating any chance of being approved by the U.S.G.A. (United States Golf Association) which is the official group that rules on which golf balls are acceptable as official golf balls to be used in golf tournaments. Also, people using this prior golf ball have indicated that they cannot hit the ball as far as conventional golf balls.

A number of other, non-related objects (not golf balls) have had phosphorescent materials applied such as disclosed in U.S. Pat. No. 3,445,551 covering a hollow, expanded ball, but not a golf ball.

Thus, a definite need existed for a glow-in-the-dark or luminescent golf ball that could be approved by the U.S.G.A., and that can be hit as far as conventional golf balls, but which would be extremely useful to golfers either seeking to finish their golf play at dusk, or for playing at night (with some exterior golf course lights to outline the general layout of the golf course including any ponds, trees, bushes, etc. to avoid injury to the golfer), or for playing golf where there are out of bound areas with relatively tall grass making normal (non-glowing) golf balls difficult to see, or for playing golf near water hazards such as small ponds that can conceal the location in the water of (non-glowing) golf balls, but might reveal the location of a glowing type golf ball.

SUMMARY OF THE INVENTION

Accordingly, it is an object of this invention to provide improved glow-in-the-dark or luminescent golf balls and fabrication methods therefor.

It is a further object of this invention to provide improved glow-in-the-dark or luminescent golf balls and fabrication methods therefor where these golf balls glow without structural changes thereto.

It is still another object of this invention to provide improved glow-in-the-dark or luminescent golf balls and fabrication methods therefor which are capable of being approved by the U.S.G.A. for golf tournaments or as an official golf ball.

According to one embodiment of the present invention, a glow-in-the-dark golf ball is provided which comprises a flexible core member, glowing means disposed on the external surface of the flexible core member for radiating a luminescent glow, and transparent cover means encircling the flexible core member with its glowing means thereon for permitting the luminescent glow to pass through the transparent cover means to make the golf ball more visible.

Another embodiment of this invention is a glow-in-the-dark or luminescent golf ball comprising a flexible core, hard plastic cover means for encircling the flexible core and for providing a resilient external surface to receive striking blows from golf clubs, and glowing means located on the exterior surface of the hard plastic cover means for providing a luminescent glow to make the golf ball more visible.

A still further embodiment of this invention is a glow-in-the-dark or luminescent golf ball comprising a flexible core, and glowing hard plastic cover means encircling the flexible core and for providing a resilient external surface to receive striking blows from golf clubs, the glowing hard plastic cover means having luminescent means disposed therein for providing a glow to make the golf ball more visible.

The foregoing and other objects, features and advantages will be apparent from the following description of the preferred embodiment of the invention as illustrated in the accompanying drawings.

DESCRIPTION OF THE PREFERRED EMBODIMENT

Figure 1:
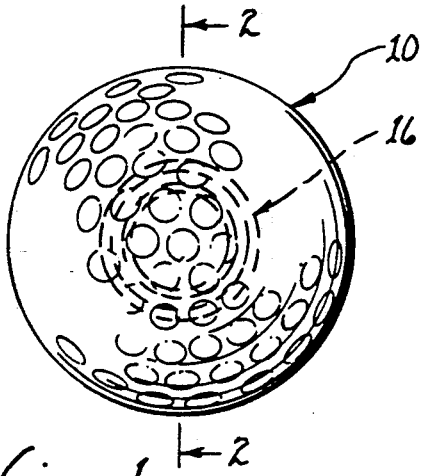
FIG. 1 is an elevation view of a golf ball according to the invention.
Figure 2:
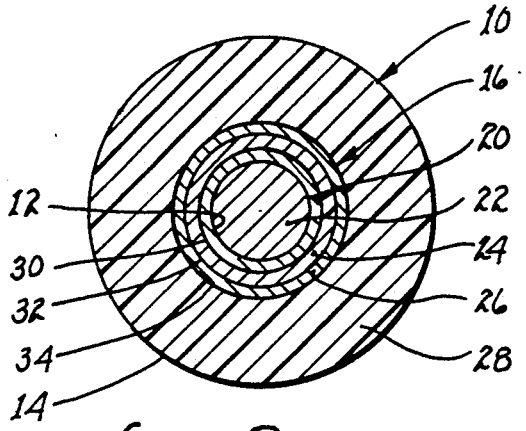
FIG. 2 is a section view taken along line 2—2 of FIG. 1.

As shown in FIGS. 1 and 2, a golf ball 10 is provided. Golf ball 10 has, like many conventional golf balls, a center ball type core 22 having an exterior surface 12 and outer covering surface 14. Thus, golf ball 10 has a flexible, resilient core or core portion generally designated by reference number 16, which has a center or center point and which includes an inner center flexible (i.e. rubber) ball type core 22. If desired, a center hollow cavity can be used instead of the inner center flexible ball. The flexible core 16 includes a sphere or spherical member 20 made of rubber type material such as either a solid rubber type material or rubber bands compressed together into the sphere which surrounds the inner, center ball core 22 which is usually made smaller in size relative to the sphere 20. A primer coat or coating 24, preferably a white or light gray lacquer primer, is first disposed over the external surface of the flexible sphere 20, and a phosphorescent or luminescent lacquer type layer or coat or coating 26, is disposed over the primer coat 24. Preferably, the luminescent layer 26 is made of a luminescent material such as the luminescent paint called by the trade name MOONGLOW which is a product of Moonglow, Inc. of Reynolds, Mo. This luminescent paint can absorb light or heat for a short period of time i.e. from 30 to 40 seconds to about 10 minutes and will then subsequently continue to emit a luminescent glow for a substantially long period of time (usually for several hours). This luminescent paint is produced in several different colors. An article describing this MOONGLOW paint is disclosed on pages 28 and 29 in the magazine entitled Custom Painting (2758-7) which was published by the Peterson Publishing Company located on Sunset Blvd., in Los Angeles, Calif. in late 1988. Preferably, several coats, such as four coats of this MOONGLOW paint is provided as the coating 26. Golf ball 10 also includes a plastic layer 28, which is composed of a translucent, transparent, clear plastic material such as the material sold under the tradename SURLYN by DuPont. This plastic material can be formed about the flexible core 16 by various known plastic forming techniques at elevated temperatures. Sphere 20 has a spherically shaped outer surface 30. The primer coat 24 also has a spherically shaped outer surface 32. The luminescent coating 26 also has a spherically shaped outer surface 34.

The advantage of the glow-in-the-dark or luminescent golf ball 10 of FIGS. 1 and 2 have been indicated above. Golf ball 10 is relatively easy to find in the dark, as during an evening golf game after sunset, because it emits a luminescent glow. Such a glow from one golf ball 10 lasts about 4 to 5 hours after light is first shined on or applied to the ball 10 which is generally enough time for an 18 hole golf game. Alternatively, heat can also be used to induce the luminescent glow from the golf ball 10. Also, the golf ball 10 is more easily found in a wooded or heavy grass or like area of a golf course due to its luminescent or phosphorescent glow. Both the flexible core 16 with its inner flexible core 22 and its outer flexible sphere 20 together with the hard plastic layer 28 cushion the force of blows from the impact by a golf club head; and are resilient enough to prevent cracking or breaking thereof when transmitting the force from the golf club head to the ball 10. The plastic layer 28, if made of transparent SURLYN, is a polymer of the class known as ionomer. Thus, the golf ball 10 can be made to provide a luminescent glow by applying light or heat thereto wherein the glow will pass from the luminescent coating 26 through the transparent, plastic layer 28.

Figure 3:
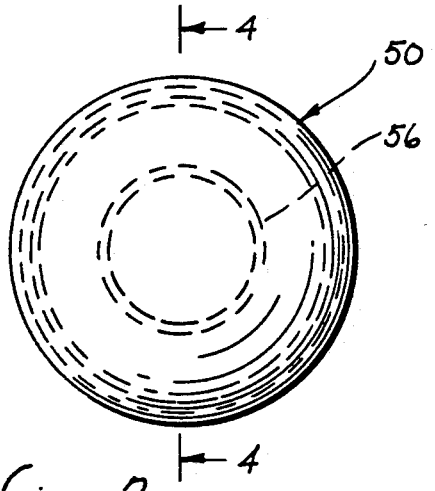
FIG. 3 is an elevation view of a second embodiment of a golf ball according to the invention.
Figure 4:
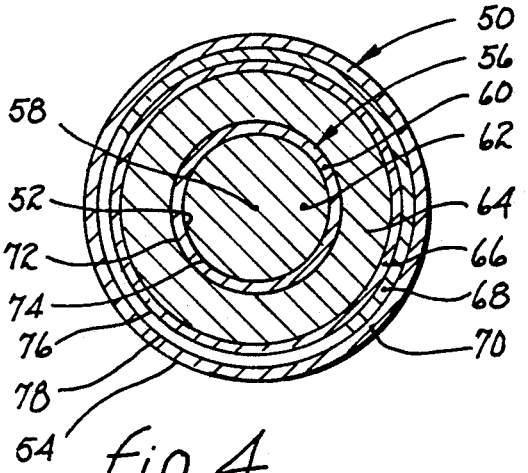
FIG. 4 is a section view taken along the line 4—4 of FIG. 3.

As shown in FIGS. 3 and 4, a second embodiment of a glow-in-the-dark golf ball 50 is provided. Golf ball 50 has a inner center flexible core 62 (like the core 22 of FIG. 2) having an outer surface 52 and an external outer surface 54 is provided for the golf ball 50 which is usually dimpled as would be the external outer surface 14 of the golf ball 10 of FIGS. 1 and 2. Again, if desired, the inner center flexible core 62 can be replaced by a hollow cavity. Golf ball 50 includes a flexible core 56 (similar to flexible core 16 of FIG. 2). A center point 58 is the center of the golf ball 50. Flexible core 56 includes a flexible sphere 60 (similar to the flexible sphere 20 of FIG. 2). If desired, another flexible sphere 64 also composed of either hard rubber or wrapped rubber strands or strings or bands like the flexible sphere 20 of FIG. 2 is disposed over or encircles flexible sphere 60. However, if desired, the flexible elements of the FIGS. 1 and 2 embodiment rather than the triple flexible element(s) shown in FIG. 4 can be used for the purposes of the glow-in-the-dark or luminescent golf ball embodiment of FIGS. 3 and 4. Golf ball 50 also includes an interior cover 66, which is disposed over or encircles the flexible sphere 64 and which is preferably composed of a relatively tough, cut-resistant plastic type material. Golf ball 50 also includes a primer coat or layer 68 like the primer coat 24 of FIG. 2, which is disposed over the inner cover 66, and further includes a luminescent or phosphorescent layer 70 (like the luminescent layer 26 of FIG. 2) which is disposed over the primer coat or layer 68. Thus, any conventional golf ball can be coated with the two layers (primer layer 68 and luminescent layer 70) to provide a glow-in-the-dark or luminescent golf ball, however, the embodiment of FIGS. 1 and 2 has, thus far, proven to be of greater use and value because the luminescent material is protected from repeated blows from golf club heads.

The flexible sphere 60 has an outer surface 72. The flexible inner core 62 has an outer surface 74. The inner cover 66 has an outer surface 76. Primer layer 68 has an outer surface 78. The thicknesses of the core 62, spheres 60 and 64, the various coatings and/or layers in FIGS. 2 and 4 are exaggerated for the purpose of illustration.

Advantages of the golf ball 50 (FIGS. 3 and 4) like the golf ball 10 (FIGS. 1 and 2) are that both of these type of golf balls glow in the dark for ease of finding the balls and the cost of producing such balls is not very high considering the advantages.

Figure 5:
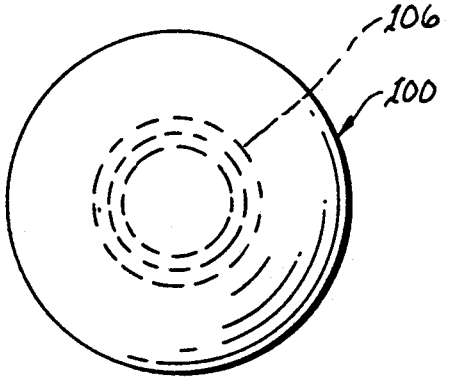
FIG. 5 is an elevation view of a third embodiment of a golf ball according to the invention.
Figure 6:
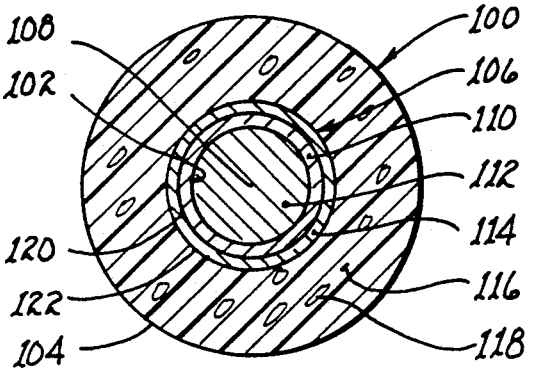
FIG. 6 is a section view taken along the line 6—6 of FIG. 5.

As shown in FIGS. 5 and 6, a third embodiment of a golf ball 100 is provided. Ball 100 has an inner flexible core 112 (like inner flexible cover 22 of FIG. 2 and 62 of FIG. 4) having an exterior surface 102 and an external cover 116 having an outer surface 104. Again, the inner flexible core 112 can be replaced by a hollow cavity, if desired. Ball 100 includes a flexible core arrangement 106 (like the similar flexible core arrangements 56 of FIG. 4 and 16 of FIG. 2). The golf ball 100 has a center 108. The flexible core 106 also comprises a flexible sphere 110 which is similar to flexible sphere 20 of FIG. 2 and 60 of FIG. 4. Ball 100 also includes a primer coat 114 (like the primer coat 24 of FIG. 2 or the primer coat 68 of FIG. 4) which is disposed over the flexible sphere 110. Ball 100 includes a (opaque, blow-cushioning, plastic) flexible layer 116, which comprises a mixture of the SURLYN material with luminescent material 118 to provide a luminescent cover material. Particles 118 in FIG. 6 are exaggerated in size. Preferably the pigments (presently there are nine different developed luminescent colors that have been disclosed by Moonglow, Inc.) of one of these luminescent colors is mixed with the SURLYN material and heated to a temperature of about 400 to 500 degrees Fahrenheit to cause the desired liquid plastic material for forming a golf ball cover over the flexible core 106 during the molding operation. Alternatively, a first thin SURLYN layer can be formed, followed by depositing the primer, followed by depositing the MOONGLOW layer, and then followed by depositing a second thin SURLYN layer thereby providing a sandwich effect with the MOONGLOW material effectively protected by two SURLYN layers.

The flexible sphere 110 has an outer surface 120. Primer coat 114 has an outer surface 122. The thickness of primer coat 114 in FIG. 6 is exaggerated in thickness for ease of illustration. It is also possible to dispense with the primer coat 114 and form the plastic type luminescent cover 116 directly on the flexible sphere 110.

The advantages of the golf ball 100 are the same as the advantages of the golf ball 10 (FIGS. 1 and 2) and the golf ball 50 (FIGS. 3 and 4) as recited herein. In addition, cover layer 116 protects particles 118, which are relatively small particles, during impact by a golf club head.

While the invention has been described in its preferred embodiments, it is to be understood that the words which have been used are words of description rather than limitation and that changes may be made within the purview of the appended claims without departing from the true scope and spirit of the invention in its broader aspects. For example, in the second embodiment of FIGS. 3 and 4, it may be desirable to better prepare the conventional golf ball surface by a surface roughening or abrasion technique before applying the primer coat. Also, a golfer playing golf at dusk or at night might simply use a flashlight or any other portable light or heat source to energize the golf ball 10, 50 or 100 to thereby generate the luminescent glow from each of these golf balls. Otherwise, holding one of these golf balls up to an incadescent or florescent light will serve to generate the luminescent glow.

The embodiments of an invention in which an exclusive property or right is claimed are defined as follows:

1. A glow-in-the-dark golf ball comprising, in combination:

a core member having an external surface;

glow-in-the-dark glowing means continuously disposed on and around the external surface of said core member for receiving at lest one of light and heat energy to generate a glow of light and for emitting said glow of light in a dark environment after receiving said at least one of light and heat energy and having an external surface; and transparent cover means disposed on said external surface of said glow-in-the-dark glowing means for both protecting said glow-in-the-dark glowing means and for permitting said glow of light from said glow-in-the-dark glowing means to pass through said transparent cover means to make said glow-in-the-dark golf ball visible in a dark environment.

2. The glow-in-the-dark golf ball of claim 1 wherein said transparent cover means is a layer of clear, translucent plastic material.

3. The glow-in-the-dark golf ball of claim 2 wherein said glow-in-the-dark glowing means comprises a primer layer in contact with said external surface of said core and a glow-in-the-dark glowing layer located on said primer layer.

4. The glow-in-the-dark golf ball of claim 3 wherein said glow-in-the-dark glowing layer is a paint layer containing glow-in-the-dark materials.

5. A method of providing a glow-in-the-dark golf ball comprising the steps of:

providing a core member having an external surface;

forming glow-in-the dark glowing means continuously on and around the external surface of said core member for receiving at least one of light and heat energy to generate a glow of light and for emitting said glow of light in a dark environment after receiving said at least one of light and heat energy, said glow-in-the-dark glowing means having an external surface; and forming transparent cover means disposed on said external surface of said glow-in-the-dark glowing means for both protecting said glow-in-the-dark glowing means and for permitting said glow of light from said glow-in-the-dark glowing means to pass through said transparent cover means to make said glow-in-the-dark golf ball more visible in a dark environment.

6. The method of claim 5 wherein said transparent cover means is a layer of clear, translucent plastic material.

7. The method of claim 6 wherein said glow-in-the-dark glowing means comprises a primer layer in contact with said external surface of said core and a glow-in-the-dark glowing layer located on said primer layer.

8. The method of claim 7 wherein said glow-in-the-dark glowing layer is a paint layer containing glow-in-the-dark materials.

9. A glow-in-the-dark golf ball comprising, in combination:

a core member having an exterior surface;

a cover encircling said core member and having an exterior surface; and glow-in-the-dark glowing means continuously encircling said core member and located between said exterior surface of said core member and said exterior surface of said cover for receiving at least one of light and heat energy to generate a glow of light and for emitting said glow of light that is visible in a dark environment after receiving said at least one of light and heat energy.

* * * * *